US006901633B2

(12) United States Patent
Chen

(10) Patent No.: US 6,901,633 B2
(45) Date of Patent: Jun. 7, 2005

(54) DOOR HINGE

(75) Inventor: Henry Chen, Taipei (TW)

(73) Assignee: Protrend Co., LTD, Taipei (TW)

( * ) Notice: Subject to any disclaimer, the term of this patent is extended or adjusted under 35 U.S.C. 154(b) by 69 days.

(21) Appl. No.: 10/671,919

(22) Filed: Sep. 24, 2003

(65) Prior Publication Data

US 2005/0060841 A1 Mar. 24, 2005

(51) Int. Cl.[7] ..... E05D 7/04; E05F 1/02
(52) U.S. Cl. ..... 16/240; 16/221
(58) Field of Search ..... 16/221, 240, 241, 16/242, 312–318, 309, 239, 235–237, 271, 16/272, 382, DIG. 34; 49/381, 382, 397–399, 49/236

(56) References Cited

U.S. PATENT DOCUMENTS 3,591,247 A * 7/1971 Berry et al. ..... 312/304
5,603,142 A * 2/1997 Dubach et al. ..... 16/247
5,781,966 A * 7/1998 Ferrari et al. ..... 16/242
6,314,616 B1 * 11/2001 King ..... 16/382
6,470,531 B2 * 10/2002 Domenig et al. ..... 16/240
6,622,343 B2 * 9/2003 Rupprechter ..... 16/242
6,698,124 B2 * 3/2004 Kump et al. ..... 40/642.02
6,701,575 B2 * 3/2004 Padiak et al. ..... 16/309

* cited by examiner

*Primary Examiner*—Robert J. Sandy
*Assistant Examiner*—Andre' L. Jackson
(74) *Attorney, Agent, or Firm*—W. Wayne Liauh

(57) ABSTRACT

A door hinge is adapted to connect a door to a vertical metal post of a sectional rack, so that an enclosed storage space may be provided on the sectional rack. The door hinge includes a fixing member for connecting to the door, a hanger for hooking to the vertical post, an adjusting member connected to the hanger, and a turning member, a spring leaf, and a torsion spring mounted between the adjusting member and the fixing member. A cushion pad is positioned between the hanger and the post and forced against the post by a tightening screw, so that two hooks provided on the hanger may be tightly engaged with hook eyes provided on the post. The door connected to the fixing member may therefore be pivotally connected to the vertical post.

4 Claims, 7 Drawing Sheets

DOOR HINGE

FIELD OF THE INVENTION

The present invention relates to a door hinge, and more particularly to a door hinge having simple structure to allow easy hooking to a metal post of sectional furniture.

BACKGROUND OF THE INVENTION

A door for wooden furniture is usually assembled and connected to the furniture using hinges, so as to be opened and closed relative to the furniture. FIGS. 1 and 2 are assembled and partially exploded perspective views, respectively, of a conventional door hinge 10, which includes a first fixing member 11 for fixing to a door 18, a second fixing member 12 for fixing to a wall surface of a storage space, such as a cabinet, an adjusting member 13 mounted on the second fixing member 12, a turning member 14 for pivotally connecting the adjusting member 13 to the first fixing member 11, a spring leaf 15, and a torsion spring 16. The adjusting member 13 is held to the second fixing member 12 with a first screw 17. The turning member 14 is pivotally connected at a first end to the first fixing member 11 and at a second end to the adjusting member 13. With the spring leaf 15, the torsion spring 16, and the turning member 14, the first fixing member 11 is allowed to turn relative to the adjusting member 13, and to automatically stay in place after being turned by 90 degrees or so. In this manner, the door 18 may be located either at a first position to close the storage space or at a second position to open the storage space and contain an angle of about 90 degrees between the first and the second position.

In connecting the door 18 to the wall surface of the storage space using the hinge 10, it is necessary to adjusting a clearance between the adjusting member 13 and the second fixing member 12, so that the door 18 may be located as close as possible to a horizontal position. The clearance between the adjusting and the second fixing member 13, 12 may be adjusted by turning a second screw 19 designed to push against the adjusting member 13. To increase the clearance between the adjusting member 13 and the second fixing member 12, the second screw 19 must be turned and loosened. Before the second screw 19 can be loosened, it is necessary to slightly loosen the first screw 17. The door hinge 10 illustrated in FIGS. 1 and 2 is one of the commercially available door hinges that has a relatively simple structure and provides relatively low structural strength.

After the door hinge 10 has been used for a period of time, screw holes on the wall surface of the storage space for engaging with the second fixing member 12 would easily become damaged to prevent the door hinge 10 from working normally. Since it is impossible to change the door hinge 10 to another fixing position, a user has no other choice but keeps using the defective door hinge and has a door 18 that could not be operated normally. In other words, a hinged door 18 is often the part of the sectional furniture that gets damaged first.

SUMMARY OF THE INVENTION

A primary object of the present invention is to provide a door hinge that is specially designed to connect a door to sectional furniture, particularly a sectional rack. The door hinge of the present invention includes hooks for hooking to a metal post of the sectional rack, so that the sectional rack may be mounted with doors to show an elegant appearance.

Another object of the present invention is to provide a door hinge that may be easily detachably hooked to a metal post of a sectional rack without damaging hook eyes on the metal post.

To achieve the above and other objects, the door hinge of the present invention mainly includes a fixing member for connecting to a door, a hanger for hooking to a vertical post, an adjusting member connected to the hanger, and a turning member, a spring leaf, and a torsion spring mounted between the adjusting member and the fixing member. The hanger is provided with two hooks that engage with hook eyes provided on the vertical post and thereby firmly connect the hanger to the post. A cushion pad is positioned between the hanger and the post. A tightening screw is threaded against the cushion pad for the hooks of the hanger to tightly engage with the hook eyes on the post. The door connected to the fixing member may therefore be pivotally mounted to the vertical post.

In the door hinge of the present invention, the adjusting member is pivotally connected at an end to the hanger, and a clearance between the adjusting member and the hanger is adjusted with an adjusting screw to locate the door at a horizontal position.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
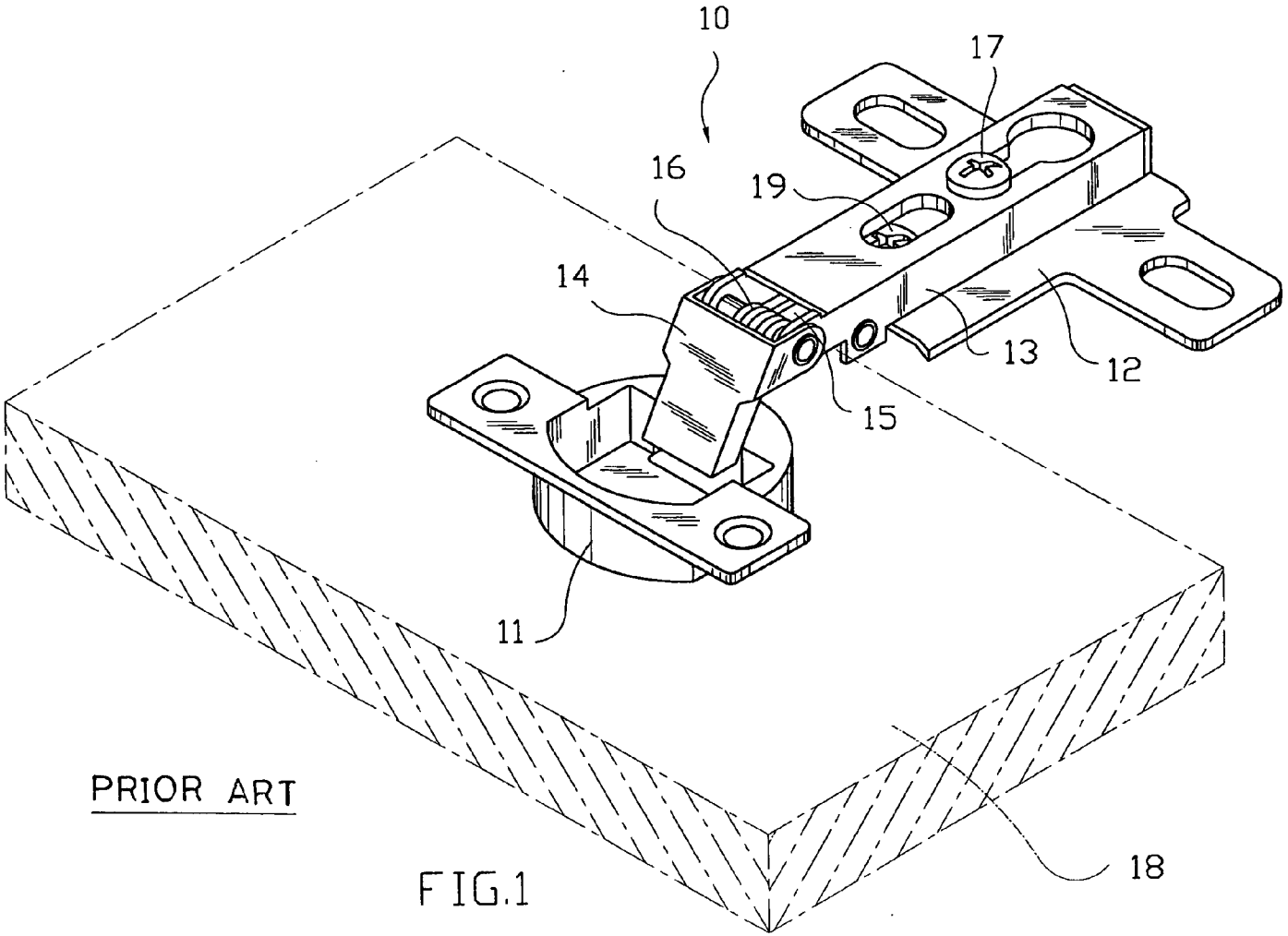
FIG.1 PRIOR ART
FIG. 1 is an assembled perspective view of a conventional door hinge.
Figure 2:
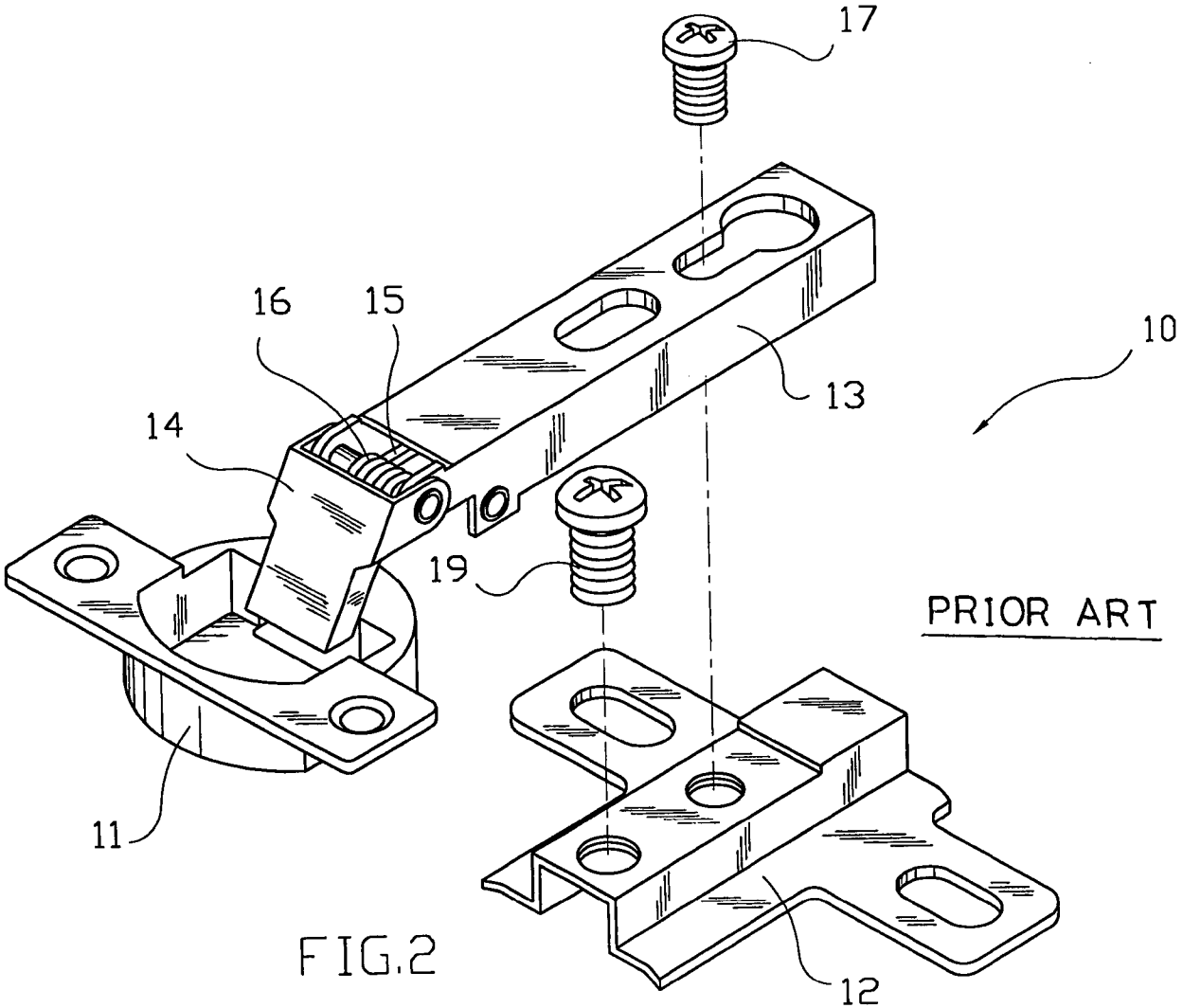
FIG. 2 is a partially exploded perspective view of FIG. 1.
Figure 3:
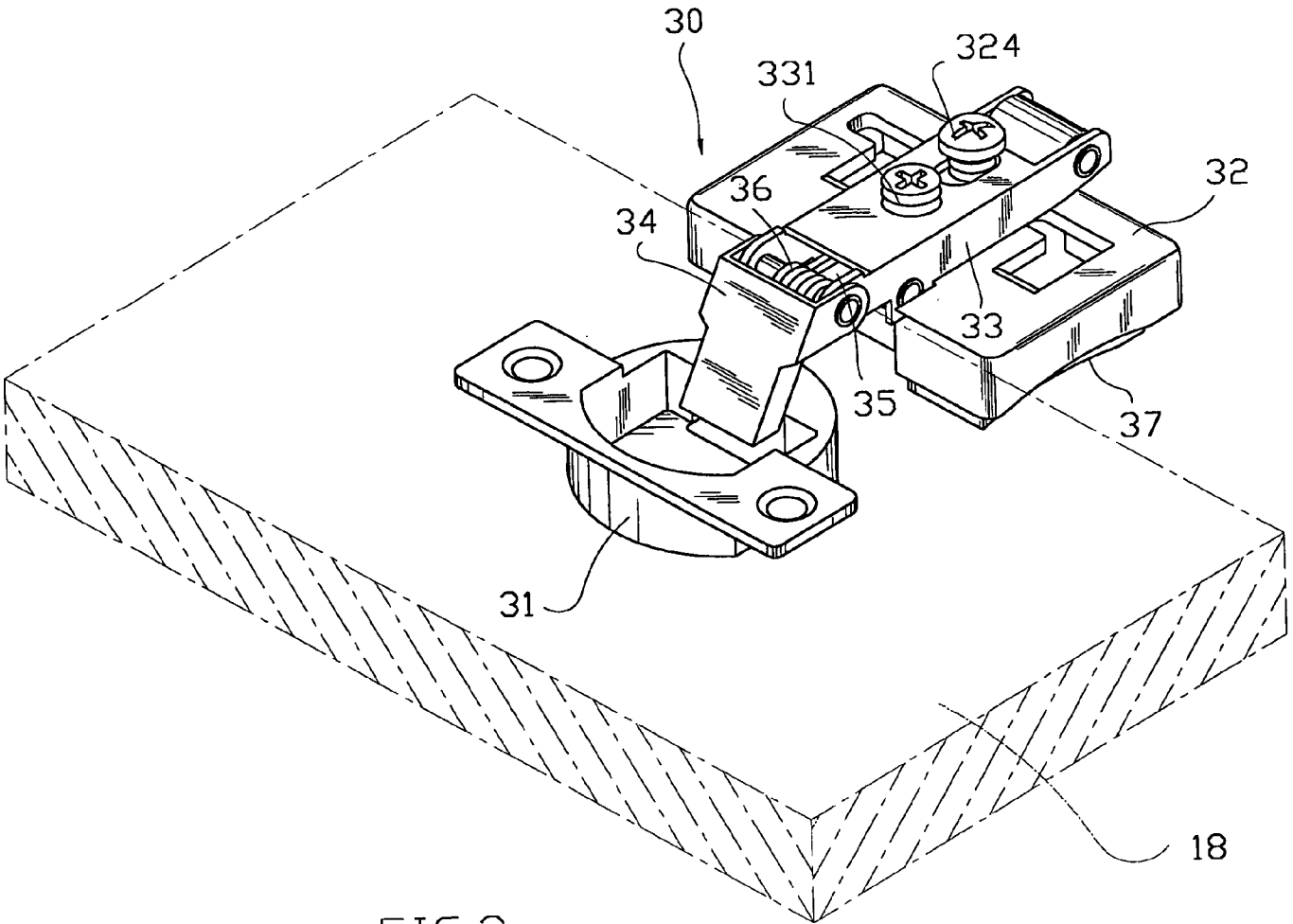
FIG. 3 is an assembled perspective view of a door hinge according to the present invention.

Please refer to FIG. 3 that is an assembled perspective view of a door hinge 30 according to the present invention adapted to hook to a metal post 20 (see FIGS. 5, 6, and 7) of a sectional rack (not shown), so that doors 18 may be connected to the metal posts 20 of the sectional rack using the door hinges 30 to define one or more closed spaces on the sectional rack.

Figure 4:
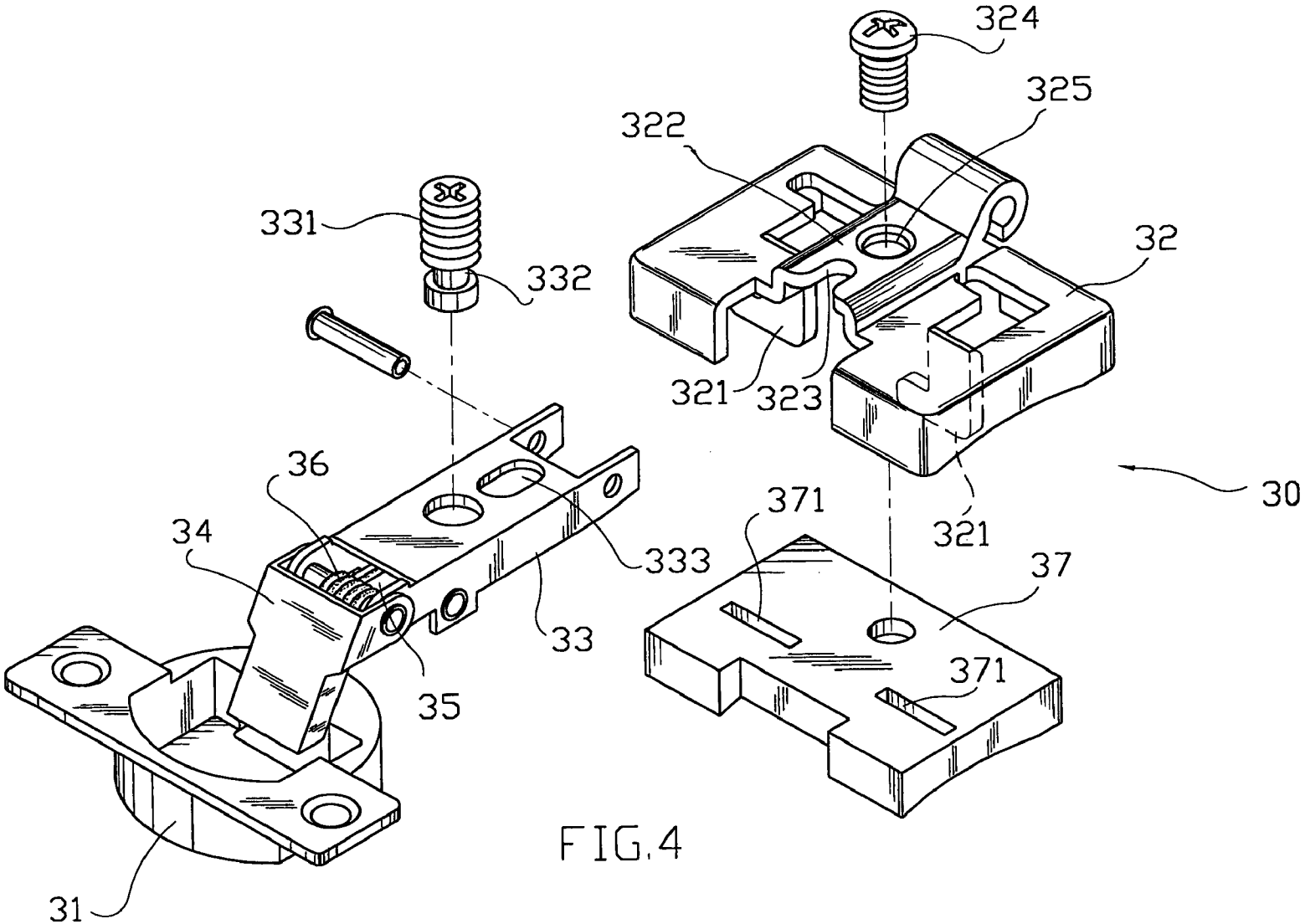
FIG. 4 is an exploded perspective view of FIG. 3.
Figure 5:
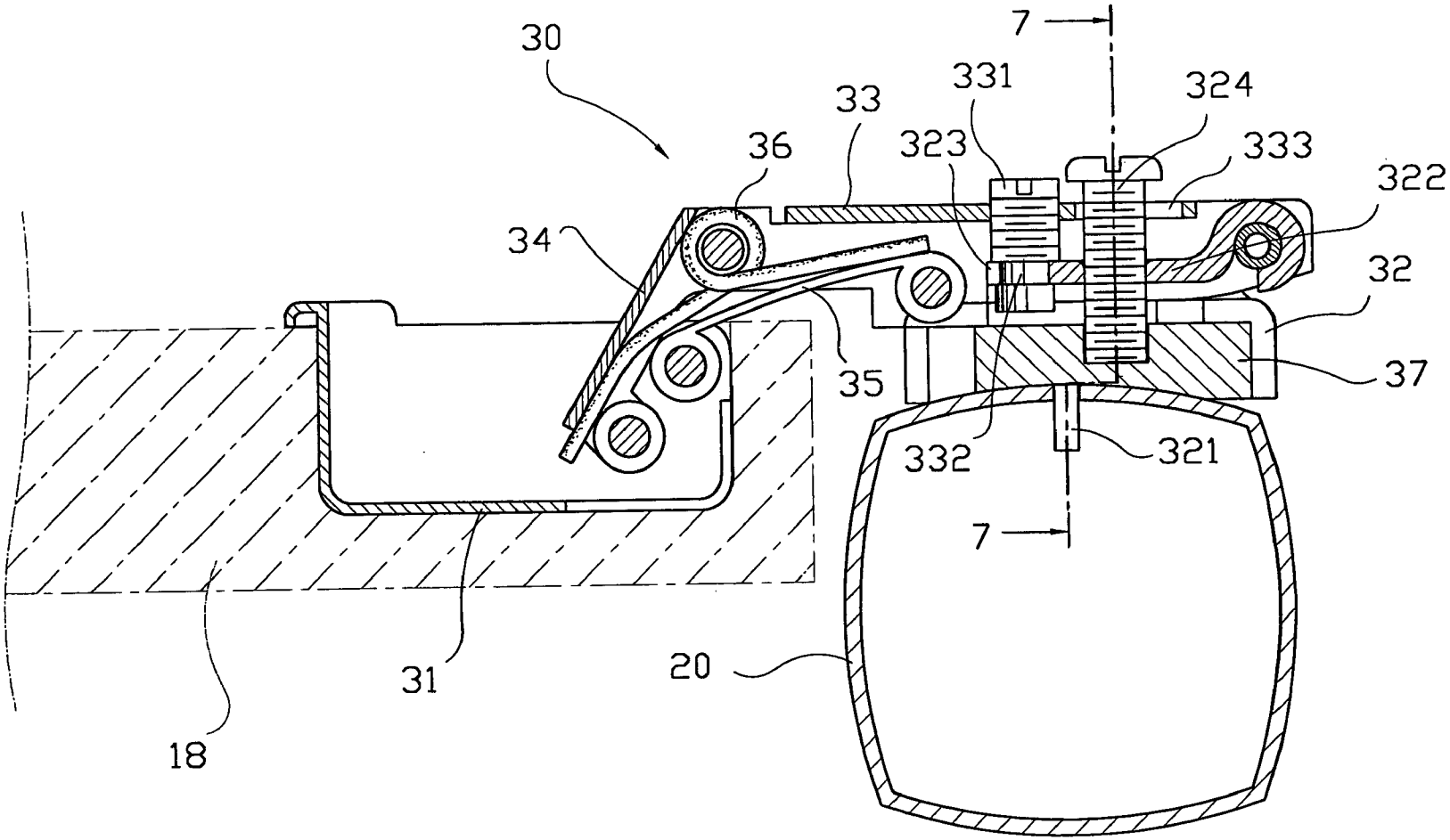
FIG. 5 is a cross sectional view showing the mounting of a door to a metal post of a sectional rack using the door hinge of the present invention.
Figure 6:
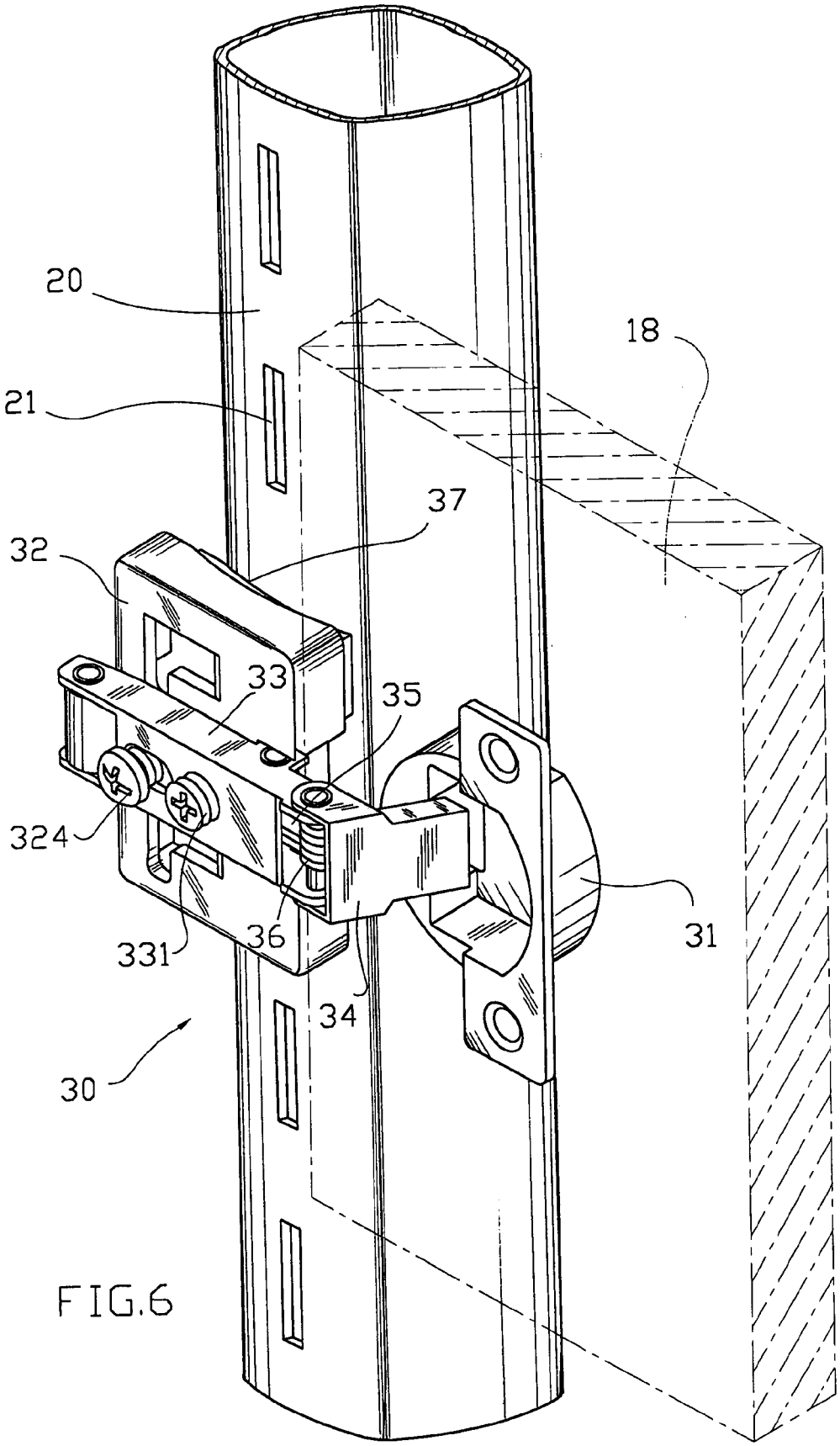
FIG. 6 is a perspective view showing the hooking of the door hinge of the present invention to the metal post of a sectional rack.
Figure 7:
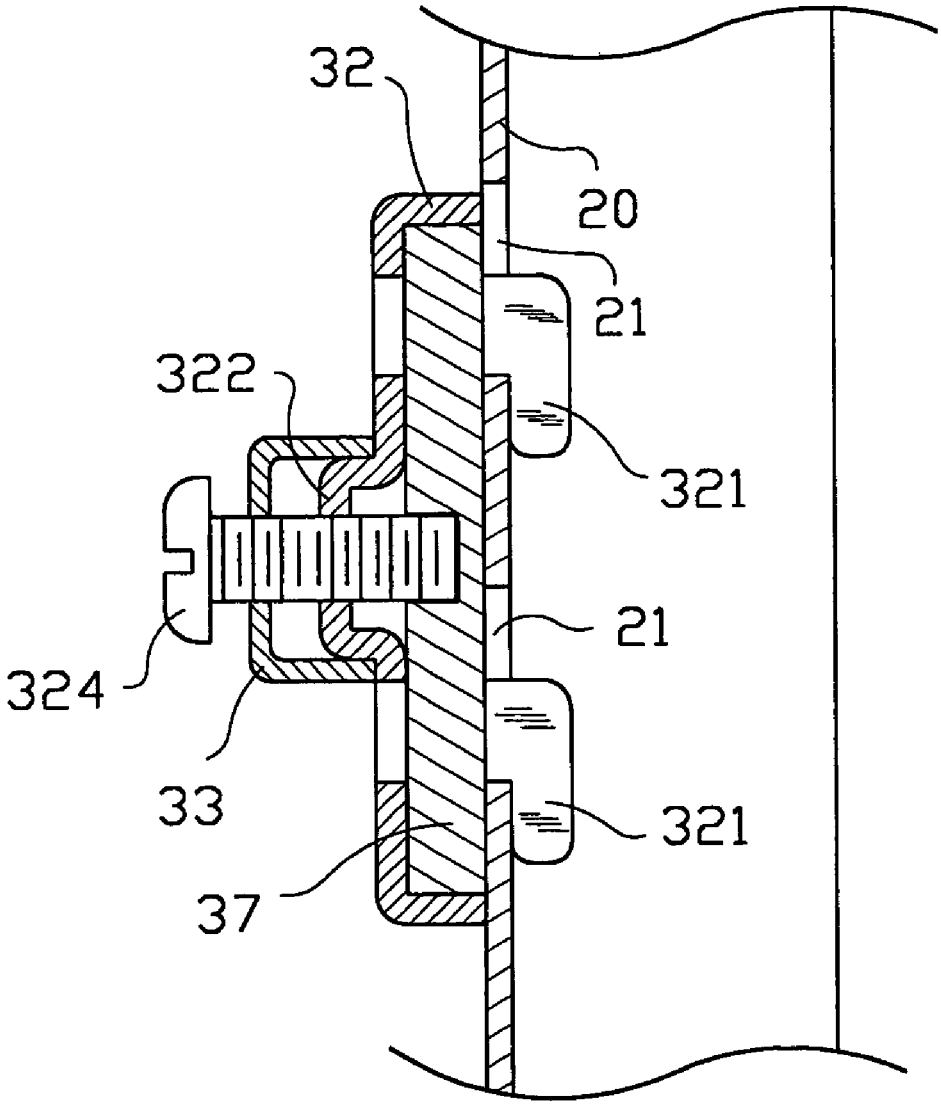
FIG. 7 is a sectional view taken along line 7—7 of FIG. 5.

Please refer to FIGS. 4, 5, and 6. The door hinge 30 of the present invention mainly includes a fixing member 31 for connecting to a door 18, a hanger 32 for hooking to a vertical post 20, an adjusting member 33 connected to the hanger 32, and a turning member 34, a spring leaf 35, and a torsion spring 36 mounted between the adjusting member 33 and the fixing member 31. The hanger 32 is provided at an inner side with an upper and a lower hook 321, and at a central area with an outward raised portion 322. The raised portion 322 has a first end pivotally connected to an end of the adjusting member 33, and a second end opposite to the first end formed into a recess 323. The hanger 32 is hooked to the metal post 20 through engagement of the upper and lower hooks 321 with hook eyes 21 provided on the metal post 20. A cushion pad 37 is positioned between the hanger 32 and the post 20. A tightening screw 324 is threaded through the hanger 32 to force against the cushion pad 37, so that the upper and lower hooks 321 of the hanger 32 firmly hook to the post 20 at the hook eyes 21 and thereby connect the door 18 to the post 20, as shown in FIG. 7.

Since the turning member 34, the spring leaf 35, and the torsion spring 36 connecting the adjusting member 33 to the fixing member 31 are known skills mainly for the door 18 to locate either at a closed position to close a storage space on the sectional rack or at an opened position from the rack by about 90 degrees, they are not discussed in details herein.

An adjusting screw 331 having an annular groove 332 is threaded through the adjusting member 33 with the annular groove 332 engaged with the recess 323 at the second end of the raised portion 322 of the hanger 32. When the adjusting screw 331 is turned, a clearance between the adjusting member 33 and the hanger 32 may be adjusted. Total two door hinges 30 are required to mount and locate one door 18 in place. After the door 18 is mounted, the clearance between the adjusting member 33 and the hanger 32 must be adjusted to locate the door 18 at a horizontal position while closing the storage space on the sectional rack.

The hanger 32 looks like a cover, and the two hooks 321 may be formed by punching or stamping the hanger 32. Edges of one side of the cover-like hanger 32 facing toward the vertical post 20 have a contour the same as or close to that of an outer surface of the vertical post 20, so that the hanger 32 could fitly bear against the post 20 after being assembled thereto.

The cushion pad 37 may be made of a plastic material to provide a degree of compressibility. One side of the cushion pad 37 facing toward the vertical post 20 is a surface adapted to fitly bear against the outer surface of the vertical post 20. The cushion pad 37 is provided at predetermined positions with two through holes 371 for the two hooks 321 of the hanger 32 to extend therethrough before engaging with the hook eyes 21 on the post 20. To facilitate easy mounting of the door hinge 10, it is preferable to attach the cushion pad 37 to the hanger 32 first. The tightening screw 324 for forcing against the cushion pad 37 is screwed onto the hanger 32. The adjusting member 33 is provided at a position corresponding to the tightening screw 324 with a long hole 333, through which the tightening screw 324 is extended to screw into a screw hole 325 on the raised portion 322 of the hanger 32, so as to apply a force against the cushion pad 37.

The above-described door hinge 30 is characterized in that it is adapted to hook to the metal post 20 of a sectional rack (not shown), so that doors 18 may be mounted on the sectional rack to produce closed storage space on the rack. Moreover, the door hinge 30 may be easily connected to and disconnected from the vertical post 20 without the risk of having a door hinge 30 unexpectedly loosening from the vertical post 20. That is, the door hinge 30 may be fixed to the vertical post 20 at the same position over a prolonged time, and may be freely moved to different positions on the vertical post 20 to allow change of the position of the door 18 on the sectional rack.

In brief, the door hinge 30 of the present invention has very simple structural design to enable hooking of it to the metal post 20, while the door hinge 30 provides all basic functions of an ordinary hinge. Therefore, the door hinge 30 allows the sectional rack assembled from metal parts to also include doors 18 and accordingly enclosed storage space, making the sectional rack more practical and convenient for use. Moreover, since the hook eyes 21 provided on the vertical post 20 are not subject to the condition of stripped threads, they would not have adverse influence on the firm hooking of the hanger 32 to the post 20.

What is claimed is:

1. A door hinge, comprising a fixing member for connecting to a door, a hanger for hooking to a vertical post, an adjusting member connected to said hanger, and a turning member, a spring leaf, and a torsion spring mounted between said adjusting member and said fixing member; said door hinge being characterized in that said hanger is provided at an inner side with an upper and a lower hook, and at a central area with an outward raised portion, which is pivotally connected at a first end to one end of said adjusting member opposite to said door, that said hanger is hooked to said vertical post through engagement of said upper and said lower hook with hook eyes provided on said vertical post, that a cushion pad is positioned between said hanger and said vertical post, and that a tightening screw is threaded through said hanger to force against said cushion pad and thereby enables said upper and said lower hook of said hanger to firmly engage with said hook eyes on said vertical post, so that said door connected to said fixing member is pivotally mounted on said vertical post.

2. The door hinge as claimed in claim 1, wherein said raised portion of said hanger is provided at a second end opposite to said first end with a recess, and said adjusting member includes an adjusting screw having an annular groove; said adjusting screw being extended through said adjusting member with said annular groove engaged with said recess on said raised portion of said hanger, so that a clearance between said adjusting member and said hanger may be adjusted by turning said adjusting screw.

3. The door hinge as claimed in claim 1, wherein one side of said cushion pad facing toward said vertical post has a configuration corresponding to that of an outer surface of said vertical post to enable fitly and tightly bearing of said cushion pad against said vertical post.

4. The door hinge as claimed in claim 3, wherein said cushion pad is provided at predetermined positions with two through holes for said upper and said lower hook on said hanger to extend through before engaging with said hook eyes on said vertical post.

* * * * *